United States Patent [19]

Bertram

[11] 3,965,502

[45] June 29, 1976

[54] FOLDING COT

[75] Inventor: Wallace H. Bertram, La Crescenta, Calif.

[73] Assignee: Goode Products, Inc., Vernon, Calif.

[22] Filed: Oct. 15, 1974

[21] Appl. No.: 514,716

[52] U.S. Cl. ..... 5/111; 5/114

[51] Int. Cl.[2] ..... A47C 17/68; A47C 17/70

[58] Field of Search ..... 5/110, 111, 114, 116, 5/117, 201, 312, 179, 180, 316; 248/188.6

[56] References Cited

UNITED STATES PATENTS

| | | | |
|---|---|---|---|
| 198,869 | 1/1878 | Bradley | 5/117 |
| 207,060 | 8/1878 | Morambert | 5/114 |
| 322,055 | 7/1885 | Fisk | 5/117 |
| 338,349 | 3/1886 | Johnstone | 5/114 X |
| 633,525 | 9/1899 | Martindale | 5/111 |
| 718,159 | 1/1903 | Rundgvist | 5/114 |
| 1,482,487 | 2/1924 | Sheets | 5/114 |
| 2,757,386 | 8/1956 | Lappin | 5/116 X |
| 3,105,976 | 10/1963 | Roche | 5/310 X |
| 3,134,987 | 6/1964 | Bertram | 5/111 |
| 3,327,982 | 6/1967 | Kramer | 5/111 |
| 3,462,773 | 8/1969 | Triplett | 5/111 |

FOREIGN PATENTS OR APPLICATIONS

| | | | |
|---|---|---|---|
| 6,261 | 12/1897 | Norway | 248/188.6 |
| 366,171 | 2/1932 | United Kingdom | 5/117 |
| 749,321 | 5/1956 | United Kingdom | 5/111 |

*Primary Examiner*—Roy D. Frazier
*Assistant Examiner*—Thomas J. Holko
*Attorney, Agent, or Firm*—Philip M. Hinderstein

[57] ABSTRACT

A full-size cot including a pair of parallel side rails, a flexible body-supporting sheet connecting the side rails, and a plurality of legs connectible to the side rails, the legs having a length which supports the body-supporting sheet at a conventional height. The legs are removable and foldable so that the entire cot may be collapsed into a smaller and more convenient size than known heretofore.

1 Claim, 7 Drawing Figures

FOLDING COT

BACKGROUND OF THE INVENTION

1. Field of the Invention

The present invention relates to folding or collapsible cots and, more particularly, to a simple, lightweight cot which can be easily folded into a relatively compact unit for transportation and storage.

2. Description of the Prior Art

Portable beds or cots of one type or another have been in use for many years. Such cots find widespread use in conjunction with such outdoor activities as mountain climbing, fishing, boating, hunting, camping, flying, trailering, and the like. Furthermore, such cots can be used as an extra bed for home use and as an emergency bed for a wide variety of purposes.

A typical portable bed or cot includes a pair of side rails, each side rail having a plurality of sections which are interconnected in a manner permitting folding of the side rails, a flexible body-supporting sheet connecting the side rails, and a plurality of support members located beneath the side rails and the body-supporting sheet for supporting the side rails and the body-supporting sheet in a horizontal plane above a support surface. Furthermore, since such a portable bed or cot is quite bulky when positioned for use, some provision is invariably made to permit folding of the cot into a relatively small, compact unit for transportation or storage. Thus, each side rail typically has a plurality of sections which are interconnected in a manner which permits folding of each side rail at least in half. In some cases, the side rails are folded in thirds.

Existing folding or collapsible cots are of two general configurations. The first type is generally referred to as a full-size cot in that the legs are from 12 to 16 inches long and support the body-supporting sheet at a height typical of a chair so that the cot may be used as a chair and so that it is convenient to get on and off thereof. In cots of this type, the legs normally remain attached to the side rails, although they are hingedly connected thereto, so that they may be folded into contact therewith. After the legs are folded against the cot, it is typically folded in half so that in the folded position, the length thereof is approximately equal to one-half the length of the cot, the width thereof is equal to the width of the cot, and the depth thereof is a matter of a few inches.

While this is a relatively compact size for many purposes, it is not a convenient size to be carried so that such cots are not used widely in conjunction with many activities, especially those including back packing, mountain climbing, hiking, and the like.

In order to solve the above problem, the other type of folding cot includes legs which are releasable from the side rails so that each side rail may be folded into two or three sections and the opposed side rails, now no longer held apart by the legs, can be brought together and the combination of side rails and body supporting sheet rolled into a relatively small size. On the other hand, even though the width and depth of the cot are now relatively small, one must still contend with the legs which still have the same width as the opened body-supporting sheet. Therefore, the common practice has been to form the legs so that each pair of legs is in the form of a substantially U-shaped member having a base and integral legs, the end portions of each of the legs connecting to the side rails. Then, by making the legs substantially shorter than the legs in a full-size cot, such as approximately 7 inches long, each leg member may be positioned alongside the folded side rail and body-supporting sheet so that in folded position, the cot has a length equal to one-third to one-half the length of the cot, a height of 2 to 3 inches, and a width of 7 to 9 inches. Such a small size cot is described and claimed in my U.S. Pat. No. 3,134,987, entitled Compact Cot, issued June 2, 1964.

While the folding cot just described has a size more suitable for use by a back packer, mountain climber, hiker, and the like, it obviously has the disadvantage that when assembled, the body-supporting sheet is supported substantially closer to the ground than normal, making the cot unsuitable for use as a chair and making it difficult to get on and off of. Therefore, what is obviously needed, but presently unavailable, is a full-size cot having the capability of folding to a size equal to or smaller than that of the small size cots.

SUMMARY OF THE INVENTION

According to the present invention, there is provided a folding cot which solves the problems discussed above in a manner unknown heretofore. The present cot is a sturdy, lightweight, full-size cot which is usable in all situations where foldable or collapsible cots have been used heretofore. On the other hand, the present cot may be folded into a smaller and more compact unit than even the small size cots produced heretofore have been foldable into. As a result, the present cot is ideally suited for use by mountain climbers, back packers, hikers, and the like. The present cot is of sturdy construction having a minimum of easily assembled parts which can be quickly assembled with little effort to form a neat appearing bed.

Briefly, the present folding cot comprises a pair of side rails, each side rail having two sections, the sections of each side rail being releasably interconnected or hingedly interconnected to permit folding of each side rail in half; a flexible body-supporting sheet connecting the side rails; and a plurality of support members located beneath the side rails and the bodysupporting sheet and being removably connectible thereto for supporting the side rails and the body-supporting sheet in a horizontal plane. According to the present invention, each of the support members comprises a pair of legs, the upper end of each leg being removably connectible to one of the side rails, the lower end of each leg being adapted to contact a horizontal support surface; a reinforcing bar positioned between the legs; and a pair of hinges connecting the ends of the reinforcing bar to the legs, at points intermediate the opposite ends thereof, the hinges permitting pivotable movement of the legs relative to the reinforcing bar between a first position in which the legs are essentially parallel to each other and perpendicular to the reinforcing bar and a second position in which the legs and the reinforcing bar are essentially parallel, the overall length of the support member with the legs in the second position being approximately equal to the length of each section of the side rails.

With the above novel construction, the support members may be removed from the side rails, each side rail folded in half and the sections of the side rails positioned side by side, the legs of the support members positioned in the second position and placed adjacent the side rails, and the four side rail sections and support members rolled in the folded support sheet to a configuration having a length equal to one-half the open length of the cot and a height and width of approximately 4 to 5 inches.

OBJECTS

It is therefore an object of the present invention to provide a folding or collapsible cot.

It is a further object of the present invention to provide a simple, lightweight cot which can be easily folded into a relatively compact unit for transportation and storage.

It is a still further object of the present invention to provide a folding cot of sturdy construction having a minimum of easily assembled parts which can be quickly assembled with little effort to form a neat appearing bed.

It is another object of the present invention to provide a lightweight cot which when folded occupies an extremely small storage space whereby the folded cot can be easily stowed and transported.

It is still another object of the present invention to provide a folding cot which is sturdy, lightweight, foldable, easily dismantled, durable and which is simple and inexpensive to construct.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

DESCRIPTION OF THE PREFERRED EMBODIMENT

Figure 1:
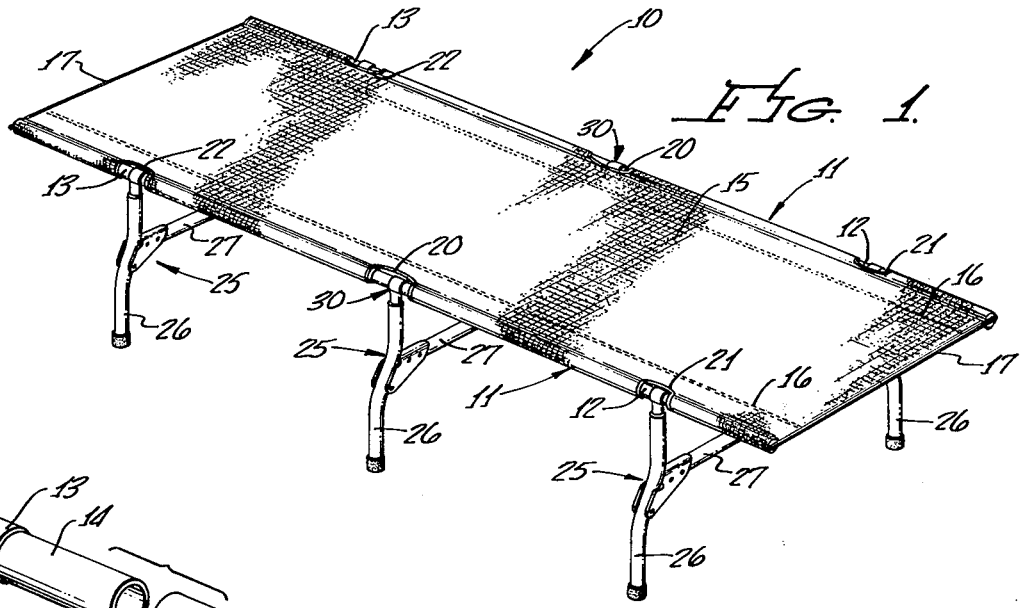
FIG. 1 is a perspective view of a folding cot constructed in accordance with the teachings of the present invention in the open assembled position ready for use.
Figure 2:
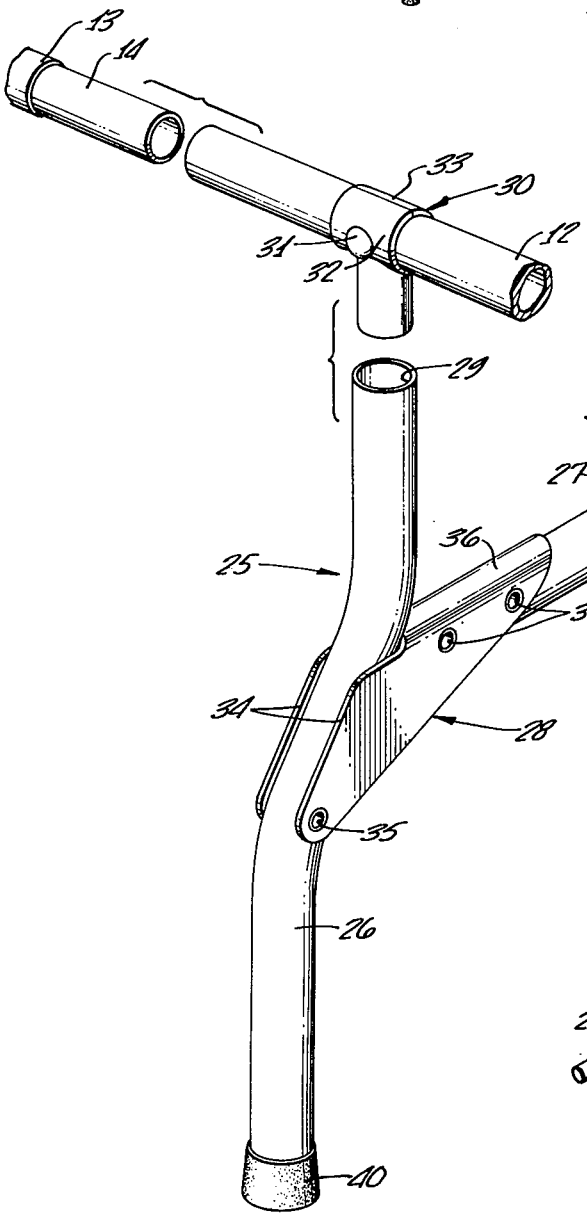
FIG. 2 is an exploded, fragmentary, perspective view of a portion of the folding cot of FIG. 1 taken at the intersection between one of the side rails and the central support member.
Figure 3:
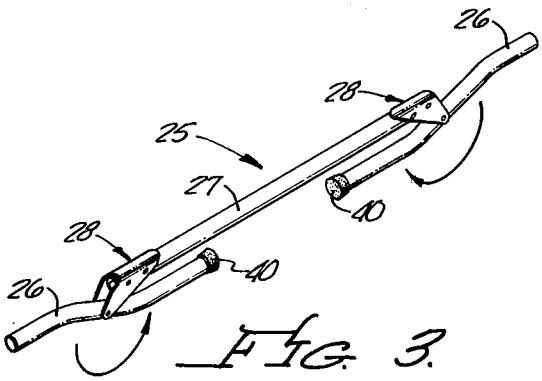
FIG. 3 is a perspective view of one of the support members of FIG. 1 showing the foldable construction of same.

Referring now to the drawings and, more particularly, to FIGS. 1–3 thereof, the present cot, generally designated 10, includes a pair of tubing side rails 11, each side rail 11 preferably having two sections 12 and 13. Sections 12 and 13 are preferably equal in length, but other arrangements are satisfactory as long as the sections of side rails 11 are symmetrical, that is, like sections of both side rails 11 are substantially identical.

Sections 12 and 13 of side rails 11 are interconnected in a manner permitting folding of each side rail 11 in half. While sections 12 and 13 of side rails 11 may be hingedly interconnected in a manner described in my before-mentioned U.S. Pat. No. 3,134,987, sections 12 and 13 of side rails 11 are preferably releasably interconnected. That is, the inner end of section 13 has a length of tubing 14 connected thereinside, tubing 14 extending beyond the inner end of section 13 and adapted to be extended into the inner end of side rail section 12. The interconnection of side rail sections in this manner is well known to those skilled in the art.

Stretched between the substantially parallel side rails 11 is a flexible body-supporting sheet 15 which provides the resting or reclining surface of cot 10 in a manner known to those skilled in the art. Sheet 15 may be essentially identical to the sheet described in my before-mentioned U.S. Pat. No. 3,134,937 and may be secured to side rails 11 by wrapping the longitudinal margins of sheet 15 around side rails 11 and firmly stitching the margin to the main body of sheet 15 with suitable strong longitudinal stitching 16, thus forming loops for side rails 11 to slide through. The loop openings, formed in sheet 15 at the ends of cot 10, are closed by stitching 17 thereby forming a pocket into which the extremities of side rail sections 12 and 13 fit thus preventing sheet 15 from slipping longitudinally on side rails 11 while cot 10 is in use. Thus, each side rail 11 is connected to the ends of a longitudinal margin of sheet 15 in such a manner that sheet 15 is biased or stretched longitudinally.

Reinforced notches 20 straddle the connection points of side rail sections 12 and 13 thus preventing fabric wear or strain at these points. Additional reinforced notches 21 and 22 adjacent the outer ends of rail sections 12 and 13, respectively, permit connection to rail sections 12 and 13 of support members, to be described more fully hereinafter. In any event, sheet 15 can be made of any suitable flexible cloth web, or fabric such as canvas, sailcloth, synthetic material such as nylon cloth and woven plastic fabric, and the like.

Body-supporting sheet 15 is transversely stretched and the pair of side rails 11 are supported and held in spaced-apart relationship in a horizontal plane by three detachable support members, generally designated 25. Since all of support members 25 are identical, both in their construction and in the manner of connection to side rails 11, a description of one will suffice to describe all. More specifically, each support member 25 includes a pair of identical legs 26, a reinforcing bar 27 positioned between legs 26, and a pair of hinges 28 connecting the ends of reinforcing bar 27 to legs 26 at points intermediate the opposite ends thereof. The upper end of each leg 26 is removably connectible to one of side rails 11 in a manner shown most clearly in FIG. 2. More specifically, each leg 26 is made from hollow tubing and has an open upper end, at 29. End 29 receives a connector 30 connected to one of side rail sections 12 or 13 by means of a rivet 31. Each connector 30 includes two halves 32 and 33, the upper portions of halves 32 and 33 being adapted to surround one of side rail sections 12 and 13 and the lower portions of halves 32 and 33 extending perpendicularly to side rails 11 and having a circular cross-section so as to extend into and support open upper end 29 of legs 26. Thus, by positioning a connector 30 adjacent the connection points of side rail sections 12 and 13 and additional connectors 30 adjacent the opposite ends of side rail sections 12 and 13, within reinforced notches 20–22, provision is made for six legs 26 which will firmly support sheet 15 in use.

As shown most clearly in FIG. 2, each leg 26 is laterally offset at a point intermediate the opposite ends thereof, the ends of each leg 26 on opposite sides of the offset portion being parallel, the upper ends of legs 26 of each support member 25 being spaced by an amount which is less than the spacing between the lower ends thereof when the legs are positioned as shown in FIGS.

1 and 2. Each of hinges 28 may consist of a flat piece of sheet metal which is folded over into a generally U-shaped configuration, each hinge 28, when viewed from the side thereof, having a generally triangular shape. One side 34 of each hinge 28 straddles the offset portion of leg 26 and one corner of each hinge 28 is pivotably connected to leg 26, at the bottom of the laterally offset portion, by a rivet 35. A second side 36 of each hinge 28 straddles one end of reinforcing bar 27 and is rigidly connected thereto by rivets 37. With such a construction, and as shown most clearly in FIG. 3, legs 26 are pivotable relative to reinforcing bar 27 between a first position in which legs 26 are essentially parallel to each other and perdendicular to reinforcing bar 27, as shown in FIGS. 1 and 2, and a second position in which legs 26 and reinforcing bar 27 are essentially parallel, as shown in FIG. 3.

While the width of cot 10 is essentially the same as conventional cots and the length of legs 26 is approximately the same as in conventional full-size cots, the construction of hinges 28 and the location of the interconnection point between legs 26 and reinforcing bars 27 is such that the overall length of each support member 25, from the upper end 29 of one leg 26 to the upper end 29 of the other leg 26, with legs 26 in the second position, as shown in FIG. 3, is approximately equal to the length of each section 12 and 13 of side rails 11, for reasons which will appear more fully hereinafter.

The lower end of each leg 26 is adapted to contact a horizontal support surface and may be closed by tightly fitting rounded caps 40. Caps 40 prevent dirt from entering the tubing ends and further protect users of the cot from injury in assembling and using the cot. A number of different materials can be used in manufacturing caps 40, such as plastic, rubber, wood, metal, and the like.

OPERATION

In the assembled position of cot 10, as shown in FIG. 1, tubing 14, connected to side rail sections 13, extends into side rail sections 12 to form continuous side rails 11. Connectors 30 extend into the open upper ends 29 of legs 26 and the cot is ready for use. Furthermore, sheet 15 prevents rotation of legs 26 around rivets 35, maintaining legs 26 firmly locked in the first position, as shown in FIGS. 1 and 2.

Figure 4:
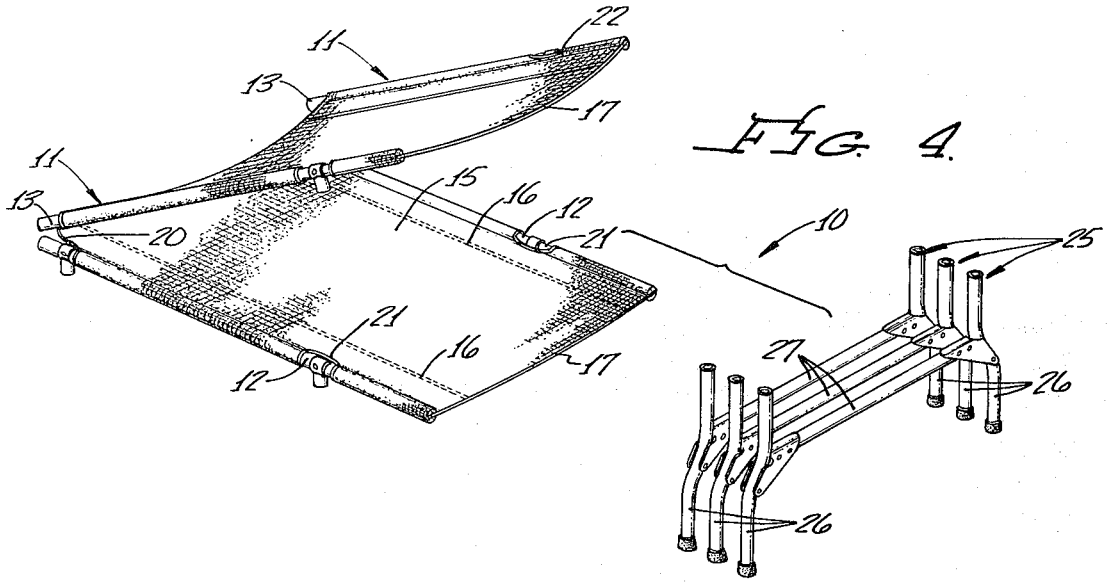
FIGS. 4–7 are a series of schematic perspective views showing the manner of folding the cot of FIGS. 1–3.
Figure 5:
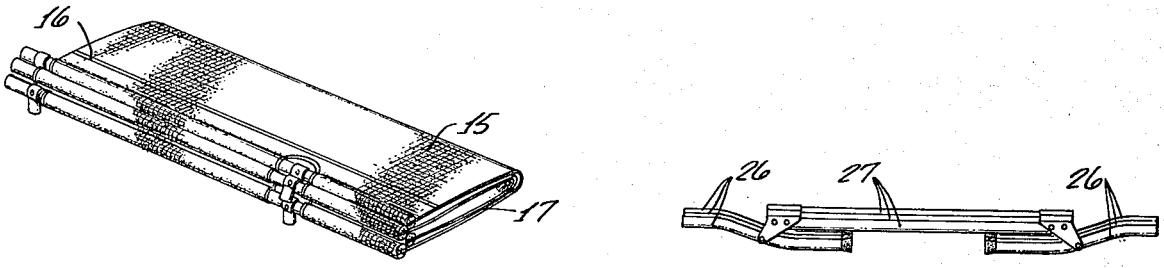
Figure 6:
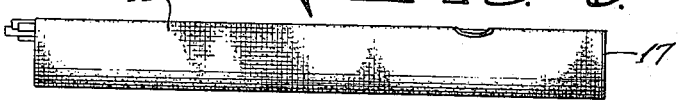
Figure 7:
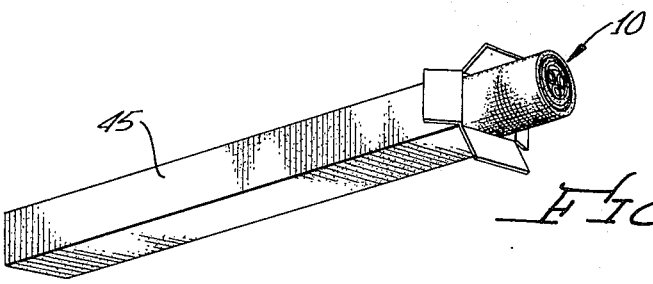

On the other hand, cot 10 is readily folded and collapsed into a smaller and more convenient size than known heretofore. That is, with all of support members 25 removed from side rails 11, as shown in FIG. 4, tubing 14 may be removed from side rail sections 13, thereby permitting each side rail 11 and sheet 15 to be folded in half until the side rail sections 12 and 13 of each side rail 11 are side by side. Thereafter, and as shown in FIG. 5, sheet 15 may be folded along its longitudinal centerline to bring the sections 12 and 13 of one side rail 11 into contact with the sections 12 and 13 of the other side rail 11. At the same time, the six legs 26 of the three support members 25 may be pivoted to the second position, parallel to reinforcing bars 27, as shown in FIG. 5.

At this time, the three support members 25 may be positioned in side by side relationship relative to sections 12 and 13 of side rails 11 and the body of sheet 15 wrapped around or folded relative to all of the tubular members. Cot 10 is now reduced to a size such that it is capable of being positioned within a box or other carrier 45 which has a length which is equal to one-half the overall length of cot 10 and has a height and width of only a few inches.

It can therefore be seen that in accordance with the present invention, there is provided a folding cot 10 which solves the problems discussed hereinabove in a manner unknown heretofore. Cot 10 is a full-size, sturdy, lightweight cot which is usable in all situations where foldable or collapsible cots have been used heretofore. On the other hand, cot 10 may be folded into a smaller and more compact unit than even the small size cots used heretofore have been foldable into. As a result, cot 10 is ideally suited for use by mountain climbers, back packers, hikers, and the like. Cot 10 is of sturdy construction having a minimum of easily assembled parts which can be quickly assembled with little effort to form a neat appearing bed.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A folding cot comprising:

a pair of side rails, each side rail having at least two sections, the sections of each side rail being interconnected in a manner permitting folding of each side rail at least in half;

a flexible body-supporting sheet connecting said side rails; and a plurality of support members located beneath said side rails and said body-supporting sheet and being removably connectible thereto for supporting said side rails and said body-supporting sheet in a horizontal plane, each of said support members comprising:

a pair of legs, the upper end of each leg being removably connectible to one of said side rails, the lower end of each leg being adapted to contact a horizontal support surface, each of said legs of each of said support members being laterally offset at a point intermediate the opposite ends thereof, the ends of each leg on opposite sides of said offset portion being parallel, the upper ends of the legs of each support member being spaced by an amount less than the spacing between the lower ends thereof when said legs are connected to said side rails;

a reinforcing bar positioned between said legs; and a pair of identical hinges connecting the ends of said reinforcing bar to said legs, each of said hinges comprising a bifurcated portion defining a pair of arms, the ends of said arms being pivotably connected to said legs adjacent the lower ends of said offset portions of said legs, said legs being positionable in first positions in which said legs are essentially parallel to each other and perpendicular to said reinforcing bar, said hinges preventing movement of said upper ends of said legs toward each other beyond said first positions, said arms straddling said offset portions of said legs when said legs are in said first positions with said upper ends of said offset portions resting against said ends of said reinforcing bar, thereby stabilizing said legs against both horizontal and vertical rotation relative to said reinforcing bar, said hinges permitting, upon removal of said upper ends of said legs from said side rails, pivotable movement of said legs relative to said reinforcing bar, in opposite directions, through angles of approximately 90°, said lower ends of said legs moving toward each other to second positions in which said legs and said reinforcing bar are essentially parallel, the overall length of said support member with said legs in said second positions being approximately equal to the length of each section of said side rails.

* * * * *